United States Patent [19]

Visco et al.

[11] Patent Number: 4,856,140

[45] Date of Patent: Aug. 15, 1989

[54] SANITARY HANDLE COVER

[76] Inventors: Frank Visco; Alfiero Balzano, both of 11782 Western Ave., #4, Stanton, Calif. 90680

[21] Appl. No.: 204,369

[22] Filed: Jun. 9, 1988

[51] Int. Cl.[4] ..... E05B 1/04

[52] U.S. Cl. ..... 16/114 R; 150/52 L; 292/DIG. 2; 379/439; 379/452; 74/558.5; 16/110 R; 16/118; 16/DIG. 30

[58] Field of Search ..... 16/110 R, 114 R, DIG. 30; 150/52 L; 292/DIG. 2; 379/439, 452; 74/558.5; 118/504; 381/181

[56] References Cited

U.S. PATENT DOCUMENTS

| | | | |
|---|---|---|---|
| 853,537 | 5/1907 | Dubisee | 292/DIG. 2 |
| 1,224,922 | 5/1917 | Hartnett | 379/452 |
| 1,389,914 | 9/1921 | Tabler | 379/439 |
| 1,491,780 | 4/1924 | Abbot | 292/DIG. 2 |
| 1,493,557 | 5/1924 | Mendoff | 379/452 |
| 1,633,988 | 6/1927 | Jones | 16/DIG. 30 |
| 2,610,877 | 9/1952 | Weaver | 16/DIG. 30 |
| 4,559,671 | 12/1985 | Andrews et al. | 16/114 R |
| 4,722,296 | 2/1988 | Bowskill et al. | 16/114 R |

FOREIGN PATENT DOCUMENTS

| | | | |
|---|---|---|---|
| 1433107 | 2/1966 | France | 379/452 |
| 2572607 | 5/1986 | France | 379/452 |
| 291237 | 5/1928 | United Kingdom | 379/452 |

*Primary Examiner*—Kenneth J. Ramsey
*Assistant Examiner*—Edward A. Brown
*Attorney, Agent, or Firm*—Roger A. Marrs

[57] ABSTRACT

A cover for a knob or handle is disclosed herein that carries a disinfectant in its porous material adapted to be slidably engaged over the knob or handle in order to substantially act as a barrier between the fingers of a person and the possible contaminated surface of the knob or handle. The cover includes a cup-like portion defining a pocket for insertably receiving the knob or handle in close frictional engagement. A neck portion extends or projects from the pocket to cover the mounting shaft of the knob or handle, and, if desired, a band retainer may be employed for holding the cover in place. A plurality of slits or openings are provided through the material, permitting the user's fingers to grab limited surface areas of the knob or handle allowing knob turning.

1 Claim, 1 Drawing Sheet

SANITARY HANDLE COVER

BACKGROUND OF THE INVENTION

1. Field of the Invention

The present invention relates to hygienic devices and more particularly to a novel cover for insertably mounting over doorknobs or handles which substantially separates the user's fingers from coming into contact with the knob or handle and which disinfects the external surface of the knob or handle in order to protect the fingers from contamination.

2. Brief Description of the Prior Art

It is the normal practice to open doorknobs or depress toilet flushing handles by grasping the knob or handle with the fingers and grabbing tightly to complete a turning or depressing procedure. In the practice of this procedure, contamination from the surface of the knob or handle can readily transfer to the flesh or fingers of the user, which is an unsanitary and nonhygienic event.

Some attempts have been made to protect the fingers by employing sprays of disinfectant substance which maintenance employees can use, as well as to employ paper towels or the like, with which a person may rub or otherwise attempt to cleanse the external surface of the knob or handle. All of these procedures are unsuccessful since they are cumbersome and require cooperation on the part of subsequent users to maintain sanitary and hygienic conditions. Furthermore, maintenance personnel only visit the knob or handle location periodically throughout a time period and, therefore, no assurance is given to the user that the knob is in sanitary condition at all times.

Therefore, a long standing need has existed to provide a novel means for maintaining a sanitary external surface of a doorknob or flushing handle to protect the fingers of the user from coming into substantial contact with contaminated surfaces of the knob or handle. Such means should be inexpensive and readily installed by non-maintenance personnel so that such means are convenient to use so as to promote the use by a variety of persons.

SUMMARY OF THE INVENTION

Accordingly, the above problems and difficulties are obviated by the present invention which provides a novel cover adapted to be insertably received over a knob or handle, and which includes a neck extension covering the mounting shaft of the knob or handle whereby the fingers of the user are substantially separated from the external surface of the knob or cover and its mounting shaft. In one form of the invention, the cover includes a pocket portion into which the knob is insertably received. In another form of the invention, a plurality of elongated slots may be placed through the material of the cover through which the flesh of the fingers may grasp the surface of the knob for turning purposes. In such an event, the disinfectant carried in the material of the cover will ensure hygienic protection.

Therefore, it is among the primary objects of the present invention to provide a novel protective means for ensuring sanitary touching, grasping and holding of knobs and handles located in a questionable hygienic site.

It is another object of the present invention to provide a novel protective cover, which will permit the user to turn or depress a knob or handle, that incorporates a disinfectant substance adapted to sanitize the outer surface of the handle or knob while permitting the user to turn or operate the handle for its intended purpose.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
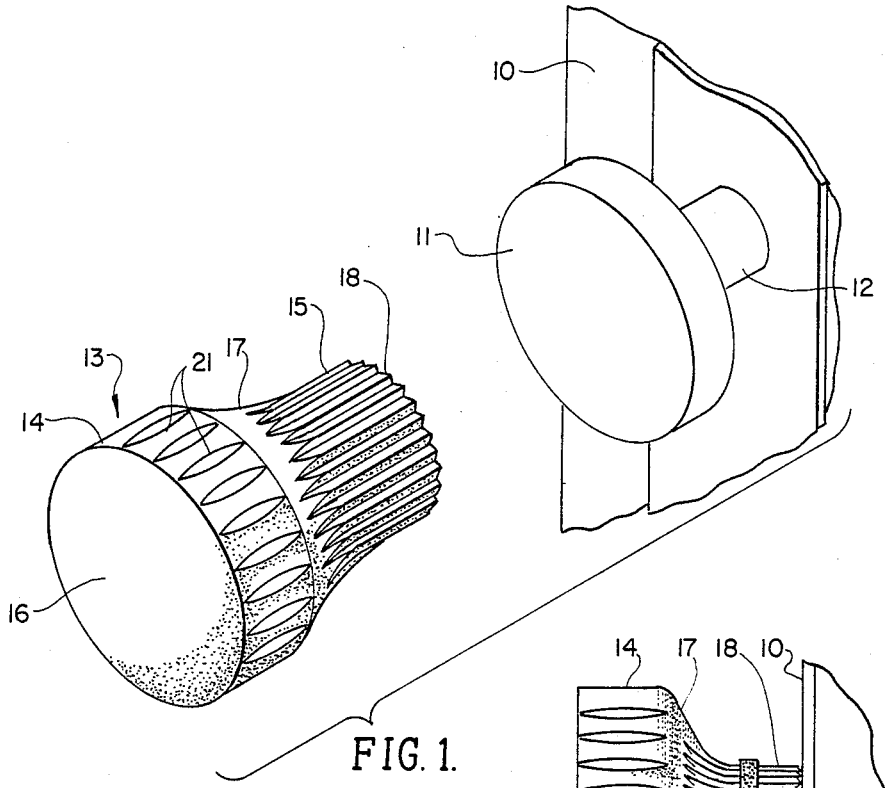
FIG. 1 is a front perspective view of a novel cover for use in connection with a doorknob.

Referring to FIG. 1, a door is indicated by numeral 10 which includes a protruding knob 11 mounted on a turning shaft 12. The knob and shaft are of conventional design and construction and are used in connection with a latch for closing the door in its doorjamb. The novel cover of the present invention is indicated in the general direction of arrow 13 which includes an elongated cup-like sheet of material that is turned over upon itself so as to provide a pocket portion 14 and a neck portion 15. The material can be composed of porous craft paper or any other sheet material which is deformable into the general cup-like configuration. The pocket portion 14 has a member 16 which terminates one end of the cover and is intended to be pressed so as to abut against the end of the knob 11. A strip or band is integrally formed with the edge marginal region of the bottom of member 16 so as to extend about the thickness of the knob 11 and terminate in a tapered portion 17, which extends behind the knob towards the mounting shaft 12. The cover further provides for an extension portion 15 which is integrally formed with the tapered portion 17. The neck portion 15 is provided with a plurality of convolutions such as indicated in general by numeral 18 whereby the paper may be pushed together around the shaft 12 for installation. Thereby, the cover may be initially carried in a holder such as a cylindrical holder 20 shown in FIG. 5 with the neck portion 15 having a diameter substantially equal to the diameter of the bottom portion 16. However, when withdrawn from the holder through an opening in the bottom, the knob may be inserted into the interior of the cover followed by a squeezing of the neck portion 15 to reduce its diameter and thereby extend behind the knob for loosely retaining the cover on the knob.

Figure 2:
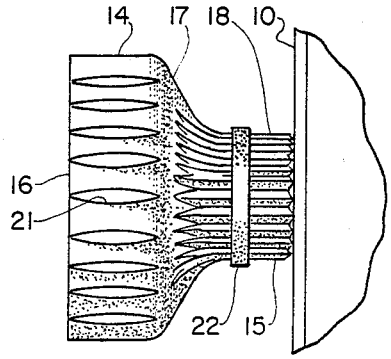
FIG. 2 is a side elevational view of the cover shown in FIG. 1 insertably received over the knob of the door.

Referring now to FIGS. 1 and 2, it can be seen that the band or strap extending about the pocket 14 includes a plurality of spaced-apart slits such as represented by numeral 21. A small portion of the external surface of the knob 11 is exposed through the plurality of slits or openings so that the user's fingers will pass through the slits into engaging contact with the surface of the knob. By this means, the user may then rotate the knob when it is desired to open or close the door. Inasmuch as the cover is impregnated with a disinfectant substance, the exposed portions of the knob are constantly cleansed and sanitized as the cover moves on the knob during normal usage.

Also, it can be seen in FIG. 2 that the neck portion 15 of the cover has been reduced in diameter by convergence of the multiplicity of convolutions 18. Further securement or retention can be assured by the use of a band or strap 22 that may take the form of an elastic band or a band having a hook and pile fastener carrying opposite ends. The neck portion 15 completely covers the mounting shaft 12 and preferably abuts against the surface of the door 10.

Figure 3:
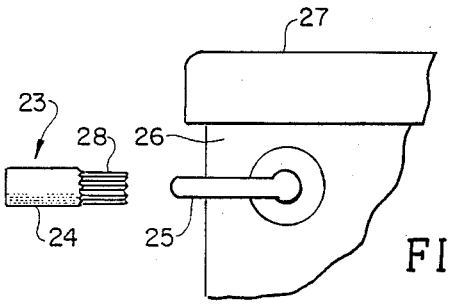
FIGS. 3 and 4 are front and top plan views respectively, showing another version of the inventive cover adapted to be insertably received over the flushing handle of a toilet.
Figure 4:
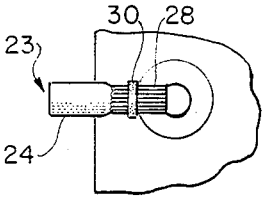

Referring now in detail to FIGS. 3 and 4, another embodiment of the invention is illustrated wherein the cover is indicated in the direction of arrow 23 and it includes an elongated portion 24 adapted to insertably receive an elongated handle 25 associated with the flushing mechanism of a conventional toilet. The mechanism is operably carried on a tank 26 which is covered by a lid 27. The cover 23 includes a neck portion 28 which is substantially similar to the portion 15 shown in the embodiment of FIGS. 1 and 2. FIG. 4 shows that a band similar to the band 22 may be used for retention if desired. The band is indicated by numeral 30.

Figure 5:
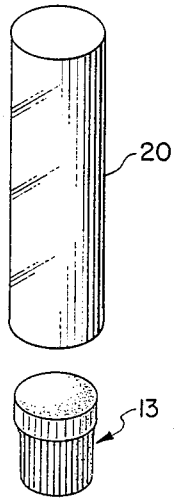
FIG. 5 is a diagrammatic view of a holder for storing a quantity of the covers used in the present invention.

FIG. 5 illustrates the holder for the covers 13, and while being held in storage within the cylindrical holder, the cover neck portion 15 may be fully expanded. Therefore, as each cover is withdrawn from the opening on the underside of the cylindrical holder, the cover will be in condition for installation over the knob 11. Again, it is to be understood that the neck portion is reduced in diameter by manual compression so that the plurality of convolutions will close behind the knob 11.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A sanitary cover in combination with a knob or handle comprising:

a knob having an exterior surface and a central longitudinal axis;

a cylindrical sheet of material having a closed end and an open end defining an internal pocket for insertably receiving said knob via said open end;

a neck portion immediately adjacent to said open end having a diameter adapted to be circumferentially reduced to gather behind said knob so as to be retained in position;

slot means extending coaxially in parallel with said central axis of said knob provided on said sheet of material for permitting limited engagement of a user's fingers with the knob for manipulation thereof;

said sheet of material impregnated with a disinfectant substance in contact with said knob or handle;

said sheet of material is configured to be substantially up-like in shape, having a circular disc bottom with an integral and carried about the periphery thereof and said neck portion outwardly extending therefrom to define said open end;

constriction means disposed on said neck portion for reducing said diameter thereof comprising a plurality of parallel convolutions integrally formed in said sheet of material collapsible to effect diameter reduction; and said slotted engagement means having a plurality of parallel elongated slots carried in said integral band exposing a limited portion of said knob exterior surface.

* * * * *